US007278957B2

(12) United States Patent
Ghim

(10) Patent No.: US 7,278,957 B2
(45) Date of Patent: Oct. 9, 2007

(54) SPORTS TRAINING DEVICE

(76) Inventor: Malthuke Sungsoo Ghim, 31 Birch Wood Ter., Nanuet, NY (US) 10954

( * ) Notice: Subject to any disclaimer, the term of this patent is extended or adjusted under 35 U.S.C. 154(b) by 697 days.

(21) Appl. No.: 10/705,993

(22) Filed: Nov. 12, 2003

(65) Prior Publication Data

US 2004/0097347 A1 May 20, 2004

Related U.S. Application Data

(60) Provisional application No. 60/425,799, filed on Nov. 13, 2002.

(51) Int. Cl.
*A63B 21/00* (2006.01)

(52) U.S. Cl. ..... 482/83; 482/90

(58) Field of Classification Search ..... 482/83–90, 482/148, 102–106, 98, 97, 94, 100; 74/500.5, 74/84, 501.6, 501.5 R, 505, 506
See application file for complete search history.

(56) References Cited

U.S. PATENT DOCUMENTS 4,883,271 A * 11/1989 French ..... 273/454
5,280,905 A 1/1994 Micco
5,723,786 A * 3/1998 Klapman ..... 73/379.04
6,435,937 B1 * 8/2002 Naegele ..... 446/298
6,508,747 B1 * 1/2003 Cook ..... 482/83
6,611,782 B1 * 8/2003 Wooster et al. ..... 702/149

* cited by examiner

*Primary Examiner*—Jerome Donnelly
(74) *Attorney, Agent, or Firm*—Ditthavong Mori & Steiner, P.C.

(57) ABSTRACT

A sports training device includes a body having at least one hitting surface sized and shaped so as to receive a punch or kick delivered by a user. A sound generator is carried by the body for generating an audible sound and includes a switch carried by the body for causing the generator to generate the sound in response to an impact created by the punch or kick. The switch is movable between first and second conditions such that the generator generates the sound when the switch is in the first condition and the generator does not generate the sound when the switch is in the second condition. The switch moves from the second condition to the first condition in response to the impact. The switch also has an impact threshold for moving the switch from the second condition to the first condition. The switch includes an adjustment device for adjusting the threshold of the switch, whereby the switch can be set at a desired sensitivity for causing the generator to generate the sound.

12 Claims, 3 Drawing Sheets

SPORTS TRAINING DEVICE

CROSS-REFERENCE TO RELATED APPLICATION

This application claims the benefit of the Nov. 13, 2002 filing date of U.S. Provisional patent application Ser. No. 60/425,799.

FIELD OF THE INVENTION

The present invention relates to sports training devices and, more particularly, to a sports training device adapted to generate audible sounds in response to impact thereto.

BACKGROUND OF THE INVENTION

Foam shields have been used during martial arts training to develop and enhance skill, muscle-coordination, etc. More particularly, these shields are shaped generally as rectangular, oval or round pillows and have front strike surfaces. In use, the shields are typically held by live-partners while trainees deliver kicks and punches against the front strike surfaces of the shields. The shields have foams or other materials for absorbing impact generated by such kicks and punches. While the shields provide an effective tool for trainees to develop martial arts skills, they are not designed to produce artificial sounds in response to impact delivered thereto. Foam shields adapted to generate such sounds would make martial arts training fun and entertaining.

SUMMARY OF THE INVENTION

The present invention overcomes the disadvantages and shortcomings of the prior art discussed above by providing a new and improved sports training device. More particularly, the sports training device includes a body having at least, one hitting surface sized and shaped so as to receive a punch or kick delivered by a user. A sound generator is carried by the body for generating an audible sound and includes a switch carried by the body for causing the generator to generate the sound in response to an impact created by the punch or kick. The switch is movable between first and second conditions such that the generator generates the sound when the switch is in the first condition and the generator does not generate the sound when the switch is in the second condition. The switch moves from the second condition to the first condition in response to the impact. The switch also has an impact threshold for moving the switch from the second condition to the first condition. The switch includes an adjustment device for adjusting the threshold of the switch, whereby the switch can be set at a desired sensitivity for causing the generator to generate the sound.

BRIEF DESCRIPTION OF THE DRAWINGS

For a better understanding of the present invention, reference is made to the following detailed description of exemplary embodiments, considered in conjunction with the accompanying drawings, in which.

DETAILED DESCRIPTION OF THE INVENTION

Although the present invention can be used in conjunction with any type of sports training devices, it is particularly suitable for use in connection with a martial arts training foam shield. Accordingly, the present invention will be described hereinafter in connection with such a foam shield. It should be understood, however, that the following description is only meant to be illustrative of the present invention and is not meant to limit the scope of the present invention, which has applicability to other types of sports training devices.

Figure 1:
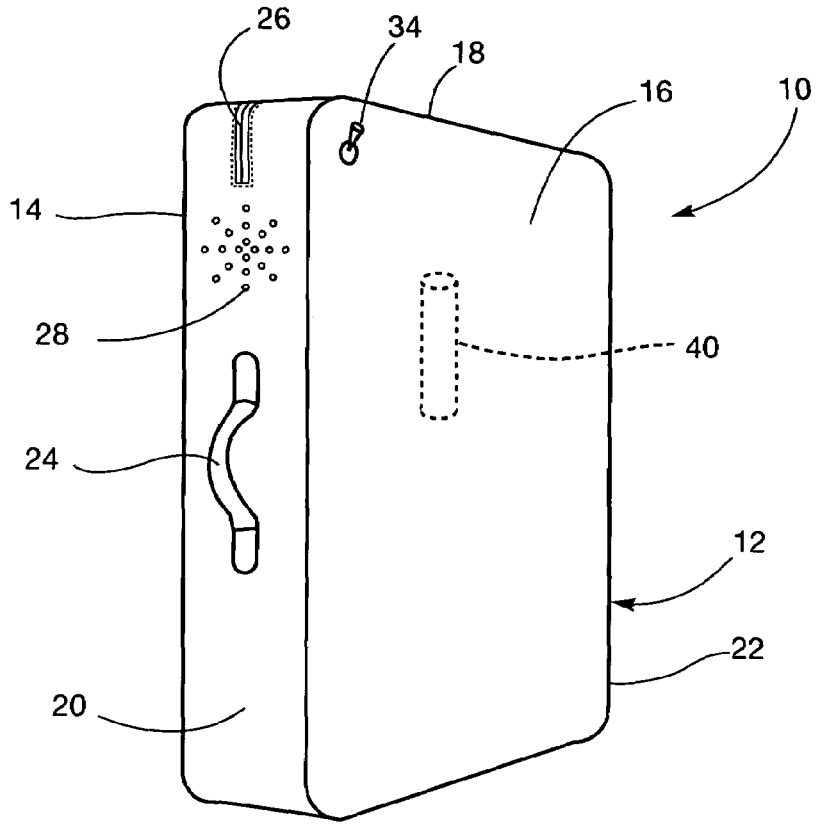
FIG. 1 is a martial arts training device constructed in accordance with the present invention.

FIG. 1 shows a foam shield 10 adapted for use in martial arts training. The shield 10 includes an outer protective cover 12 having a front strike surface 14, a rear surface 16, an upper side 18 and a pair of lateral sides 20, 22 and is sized and shaped such that athletes can deliver impact (e.g., punches, kicks, etc.) against the front strike surface 14 during training. A strap 24 is attached to each of the lateral sides 20, 22 of the cover 12 so that the shield 10 can be gripped or held by a live partner. The cover 12 has an opening/closing mechanism 26 (e.g., a zipper) provided in the upper side 18 and in upper portions of the lateral sides 20, 22 so that the cover 12 can be opened for providing access to the interior of the shield 10. The lateral side 20 of the cover 12 also has a plurality of holes 28 formed therein for purposes to be discussed hereinafter. The shield 10 also includes a foam positioned within the cover 12 for absorbing impact (e.g., kicks, punches, etc.) delivered to the front strike surface 14 by an athlete.

Figure 2:
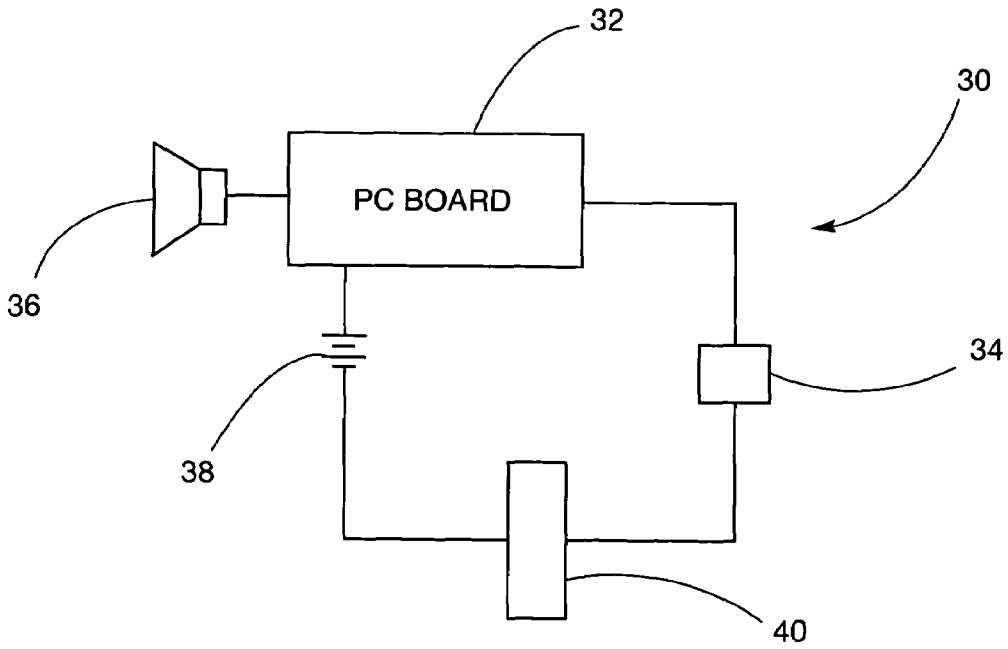
FIG. 2 is a schematic diagram of a sound generator utilized in the training device shown in FIG. 1.

With reference to FIG. 2, a sound generator 30 is housed within the cover 12 of the shield 10 for generating predetermined audible sounds in response to an impact delivered by an athlete. More particularly, the sound generator 30 includes a PC board 32 (i.e., a microprocessor) equipped with a plurality of conventional electronic components. The PC board 32 is preferable positioned in the cover 12 toward the rear surface 16 thereof. An on/off switch 34 (see also FIG. 1) is connected to the PC board 32 and is mounted on the rear surface 16. The sound generator 30 also includes a speaker 36 connected to the PC board 32. The speaker 36 is mounted within the cover 12 and is attached to the lateral side 20 of the cover 12 such that it is generally aligned with the holes 28 (see FIG. 1) to facilitate the transmission of sounds therefrom. A power source 38 (e.g., a battery or batteries) is also connected to the PC board 32 for supplying electrical power thereto.

Figure 3:
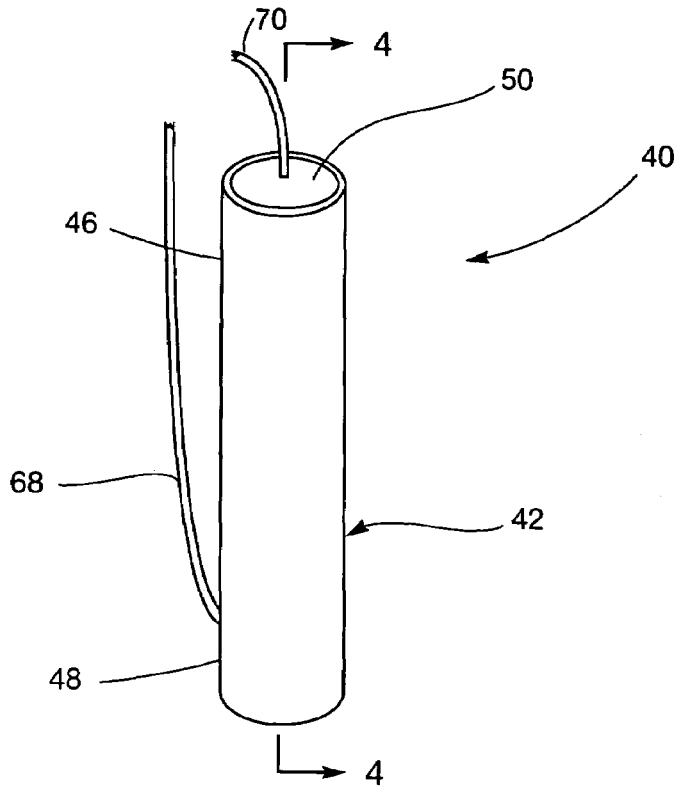
FIG. 3 is a perspective view of an impact sensor switch utilized in the training device shown in FIG. 1.
Figure 4:
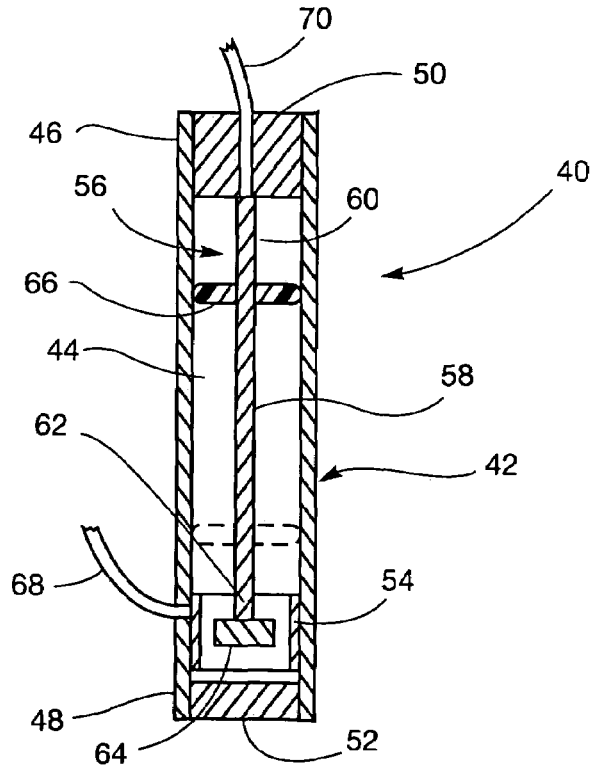
FIG. 4 is a cross-sectional view, taken along section line 4-4 and looking in the direction of the arrows, of the impact sensor switch shown in FIG. 3.

Now referring to FIGS. 3 and 4, an impact sensor switch 40 is also connected to the PC board 32 and mounted within the cover 12 toward the rear surface 16 of the shield 10 (as indicated by the broken line representation of the impact sensor switch 40 in FIG. 1). More particularly, the impact sensor switch 40 is adapted to close or complete an associated switch circuit of the PC board 32 in response to an impact delivered to the shield 10 by an athlete and to thereby cause the PC board 32 to transmit electrical signals to the speaker 36 for generating predetermined audible sounds. The impact sensor switch 40 has an elongated housing 42 including an opening 44, which extends through the housing 42, and a pair of opposing ends 46, 48. End caps 50, 52 are mounted to the ends 46, 48, respectively, of the housing 42 for closing off same. A contact ring 54 is fixedly mounted in the opening 44 of the housing 42 adjacent the end 48, while a contact assembly 56 is mounted in the opening 44 of the housing 42. The contact assembly 56 includes a substantially rigid wire 58 having a pair of ends 60, 62 and made from a conductive material (e.g., steel). A contact plate 64 is attached to the end 62 of the wire 58, while an adjustment plate 66 is attached to the wire 58 adjacent the end 60. More particularly the wire 58 extends through the adjustment plate 66 and is supported in the opening 44 of the housing 42 by the adjustment plate 66 such that the contact plate 64 is normally out of contact with the contact ring 54. The wire 58 is provided with sufficient flexibility and the contact plate 64 is provided with sufficient weight such that the contact plate 64 is, engageable with the contact ring 54 in response to impact delivered to the shield 10. An electrical wire 68 extends through the housing 42 and is connected to the contact ring 54, while an electrical wire 70 extends through the end cap 50 and is connected to the end 60 of the wire 58. The electrical wires 68, 70 connect the impact sensor switch 40 to the PC board 32.

With reference to FIG. 4, the adjustment plate 66 is movably mounted in the opening 44 of the housing 42. More particularly, the adjustment plate 66 is movable on said wire 58 such that it can be set at one of a plurality of positions along at least one portion of the wire 58 so as to control the sensitivity or impact threshold of the impact sensor switch 40. For instance, when the adjustment plate 66 is positioned in close proximity to the contact ring 54 (as indicated by the broken line representation of the adjustment ring 66 in FIG. 4), a greater force or impact is required to cause the contact plate 64 to come in contact with the contact ring 54. When the adjustment plate 66 is positioned toward the end 60 of the wire 58 (as indicated by the solid line representation of the adjustment plate 66 in FIG. 4), less force or impact is required to cause the contact plate 64 to come in contact with the contact ring 54. In this manner, by adjusting the position of the adjustment plate 66, the desired sensitivity of the impact sensor switch 40 can be selected. In this regard, the adjustment plate 66 is adapted to form a friction fit with the inner wall of the housing 42 such that the adjustment plate 66 can be maintained at one of the plurality of positions along the wire 58 between the ends 60, 62.

In operation, the on/off switch 34 is positioned in its "on" position. When an impact (e.g., a kick or punch) is delivered by an athlete to the shield 10, the contact plate 64 moves in response thereto and comes in contact with the contact ring 54, thereby closing or completing the associated switch circuit of the PC board 32. As a result, the PC board 32 sends electrical signals to the speaker 36, which, in turn, converts the signals into audible sounds, thereby making martial arts training fun and entertaining. The audible sounds can include a variety of sounds, such as human voices and training instructions.

Figure 5:
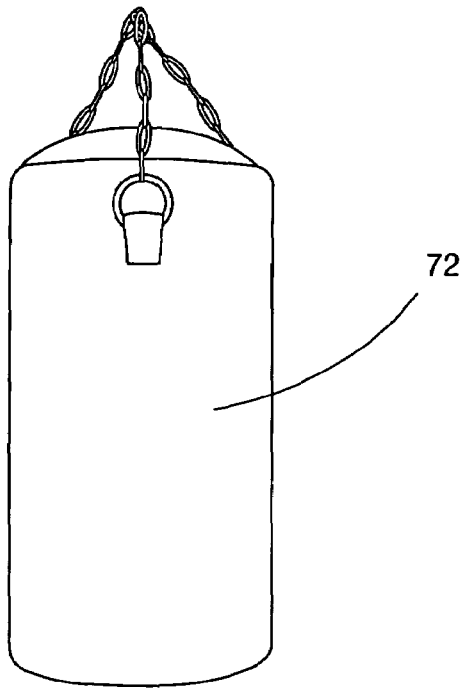
FIGS. 5 and 6 are perspective views of different types of training devices which can be used in connection with the present invention.
Figure 6:
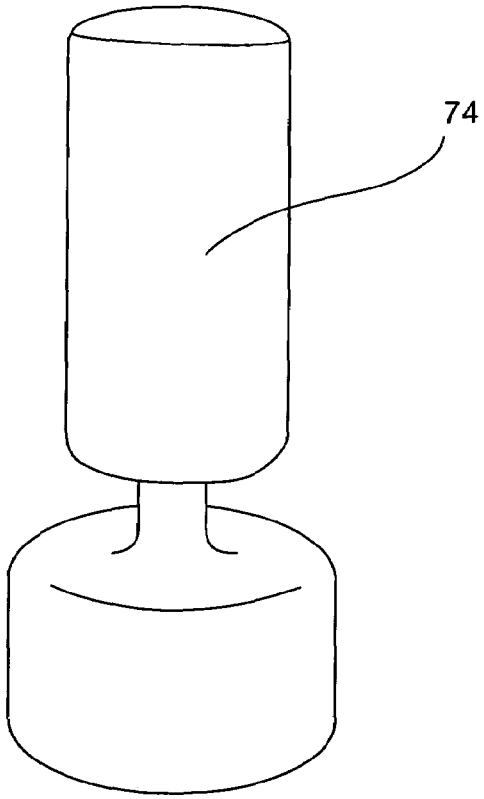

It should be noted that the present invention can have numerous variations and modifications. For instance, the PC board 32 can be provided with any conventional electronic circuit design adapted to transmit suitable signal to the speaker 36 in response to the contact between the contact plate 64 and the contact ring 54. In addition, the sound generator 30 can be modified to have a different circuit design. The impact sensor switch 40 can also be replaced with different types of switches adapted to be in a closed condition when it senses impact to the shield 10. Moreover, the present invention can be used in connection with different types of sports/martial arts training devices, such as a heavy bag 72 (see FIG. 5), a free-standing bag 74 (see FIG. 6) or other types of punching bags.

It will be understood that the embodiments described herein are merely exemplary and that a person skilled in the art may make many variations and modifications without departing from the spirit and scope of the invention. All such variations and modifications, including those mentioned above, are intended to be included within the scope of the invention as defined in the appended claims.

I claim:

1. A sports training device adapted for receiving punches and kicks delivered by a user, comprising a body having at least one hitting surface, said hitting surface being sized and shaped so as to receive a punch or kick; and a sound generator carried by said body for generating an audible sound, said generator including a switch carried by said body for causing said generator to generate the sound, said switch having first and second states such that said generator generates the sound when said switch is in its said first condition and said generator does not generate the sound when said switch is in its second condition, and said switch moving from its said second condition to its said first condition in response to the impact and wherein said switch has a threshold for causing said switch to be in its said first condition in response to the impact, said switch including adjusting means for adjusting said threshold, whereby said switch can be set at a desired sensitivity for causing said generator to generate the sound, said switch includes a contact member and a housing, said contact member being mounted in said housing and being movable relative to said housing between first and second positions, said contact member moving from its said second position to its said first position in response to the impact, said switch being in its said first condition when said contact member is in its said first position, and said switch being in its second condition when said contact member is in its said second position, said switch includes a wire mounted in said housing, said contact member being attached to said wire such that said contact member is being movable between its said first and second positions, said adjusting means includes an adjustment plate mounted in said housing and attached to said wire such that said contact member is movable between its said first and second positions, and said adjustment plate is movable along at least one portion of said wire such that said adjustment plate can be set at one of a plurality of locations along said at least one portion of said wire for adjusting said threshold of said switch.

2. The device of claim 1, wherein said wire extends through said adjustment plate and has first and second opposing ends, said contact member being attached to said first end of said wire, said adjustment plate being movable between said first and second ends of said wire such that said adjustment plate can be set at said one of said plurality of positions between said first and second ends of said wire.

3. The device of claim 2, wherein said housing has an inner wall, said adjustment plate being sized and shaped so as to engage said inner wall such that a friction fit is formed between said adjustment plate and said inner wall, said adjustment plate being maintained at said one of said plurality of locations by said friction fit.

4. The device of claim 3, wherein said housing has an elongated shape and has an opening therethrough, said wire, said contact member and said adjustment plate being positioned in said opening, said wire extending through said opening in an axial direction generally parallel to a longitudinal axis of said housing, said adjustment plate being movable in said axial direction.

5. The device of claim 4, wherein said housing includes a contact area formed on said inner wall, said contact member being in contact with said contact area when said contact member is in its said first position, said contact member being out of contact with said contact area when said contact member is in its said second position, said contact area and said contact member being electrically connected to said generator for causing said generator to generate the sound.

6. The device of claim 5, wherein said generator includes a speaker and a microprocessor unit, said switch being electrically connected said microprocessor unit, and said speaker being electrically connected to said microprocessor unit.

7. The device of claim 4, wherein said body includes an impact-absorbing material therein, said body being sized and shaped so as to be held by a person's hand during training.

8. A sports training device adapted for receiving punches and kicks delivered by a user, comprising a body having at least one hitting surface, said hitting surface being sized and shaped so as to receive a punch or kick; a sound generator carried by said body for generating an audible sound; and a switch carried by said body and electrically connected to said generator for causing said generator to generate the sound in response to an impact created by the punch or kick, said switch including a housing, a wire, which is mounted in said housing, and a contact member, which is mounted in said housing, said contact member being attached to said wire such that said contact member is movable relative to said housing between first and second positions, said contact member being movable from its said second position to its said first position in response to the impact, said switch causing said generator to generate the sound when said contact member in its said first position, and said switch including an adjustment plate mounted in said housing and movable along at least one portion of said wire such that said adjustment plate can be set at one of a plurality of locations along said at least one portion of said wire for adjusting an impact threshold of said switch.

9. The device of claim 8, wherein said wire extends through said adjustment plate and has first and second opposing ends, said contact member being attached to said first end of said wire, said adjustment plate being movable between said first and second ends of said wire such that said adjustment plate can be set at said one of said plurality of positions between said first and second ends of said wire.

10. The device of claim 9, wherein said housing has an inner wall, said adjustment plate being sized and shaped so as to engage said inner wall such that a friction fit is formed between said adjustment plate and said inner wall, said adjustment plate being maintained at said one of said plurality of locations by said friction fit.

11. The device of claim 10, wherein said housing has an elongated shape and has an opening therethrough, said wire, said contact member and said adjustment plate being positioned in said opening, said wire extending through said opening in an axial direction generally parallel to a longitudinal axis of said housing, said adjustment plate being movable in said axial direction.

12. The device of claim 11, wherein said housing includes a contact area formed on said inner wall, said contact member being in contact with said contact area when said contact member is in its said first position, said contact member being out of contact with said contact area when said contact member is in its said second position, said contact area and said contact member being electrically connected to said generator for causing said generator to generate the sound when said contact member is in its said first position.

* * * * *